United States Patent [19]

Gustafsson et al.

[11] Patent Number: 4,486,704

[45] Date of Patent: Dec. 4, 1984

[54] CONTROL DEVICE FOR AN ELECTROSTATIC DUST SEPARATOR

[75] Inventors: Alf G. Gustafsson; Sigvard Matts, both of Växjö, Sweden

[73] Assignee: Flakt Aktiebolag, Nacka, Sweden

[21] Appl. No.: 398,654

[22] Filed: Jul. 15, 1982

[30] Foreign Application Priority Data

Jul. 28, 1981 [DE] Fed. Rep. of Germany ..... 8104574

[51] Int. Cl.[3] ..... B03C 3/68

[52] U.S. Cl. ..... 323/246; 55/105; 55/139; 323/903

[58] Field of Search ..... 55/105, 139; 323/235, 323/241, 246, 903

[56] References Cited

U.S. PATENT DOCUMENTS

| | | | |
|---|---|---|---|
| 2,724,086 | 11/1955 | Lindberg . | |
| 2,978,065 | 4/1961 | Berg . | |
| 3,507,096 | 4/1970 | Hall et al. | 323/903 X |
| 4,290,003 | 9/1981 | Lanese | 323/903 X |
| 4,390,831 | 6/1983 | Byrd et al. | 323/903 X |

FOREIGN PATENT DOCUMENTS

| | | |
|---|---|---|
| 0030320 | 11/1980 | European Pat. Off. . |
| 0031056 | 12/1980 | European Pat. Off. . |
| 2949764 | 7/1981 | Fed. Rep. of Germany . |

*Primary Examiner*—William M. Shoop

*Attorney, Agent, or Firm*—Dann, Dorfman, Herrell and Skillman

[57] ABSTRACT

A control device for an electrostatic dust separator (10,11) intended to control in relation to the recorded level of direct current (104) and direct current voltage (102) in the dust separator and with the help of the supply voltage (*6a*) passes through the zero point the switching in and/or out of the rectifiers (8, 8*a*) wired into the power supply lead (*6a*) to the dust separator, usually in the form of two thryistors. The recorded value for the current (104) and the recorded value for the voltage (102) together with the information in respect of the passage through zero of the supply voltage (100) are connected directly via conversion circuits (25, 26) to a data processing unit (112). This (112) is so arranged that in relation to the value (102, 104) of the actual direct current and direct current voltage in the dust separator and with reference to the passages through zero (100) it will on the one hand calculate a specific time interval for the switching in and/or switching out of the rectifier (8) from the power supply and on the other hand generate switching-in and switching-out pulses (112*a*, 112*b*). These switching-in and switching-out pulses are fed directly, via adapter circuits, from the data processing unit.

11 Claims, 14 Drawing Figures

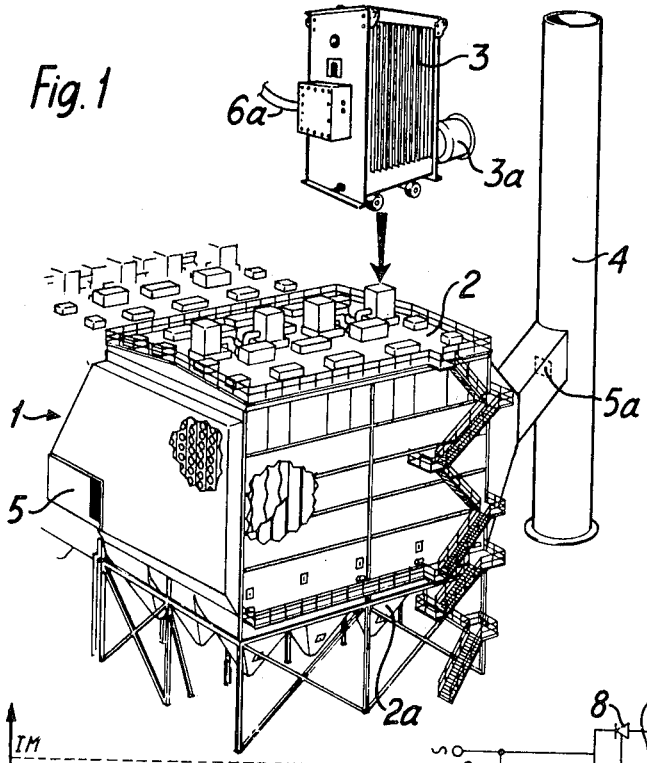
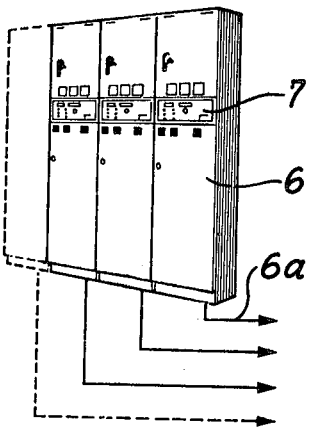
Fig. 2
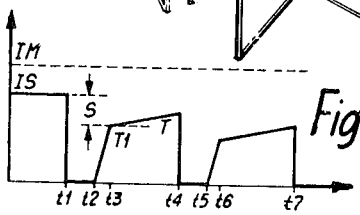
Fig. 3
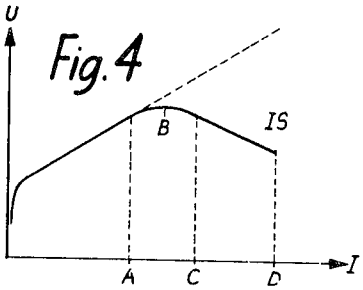
Fig. 4
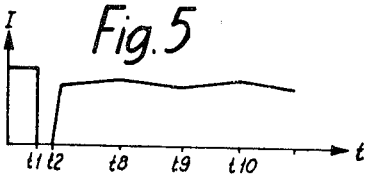
Fig. 5
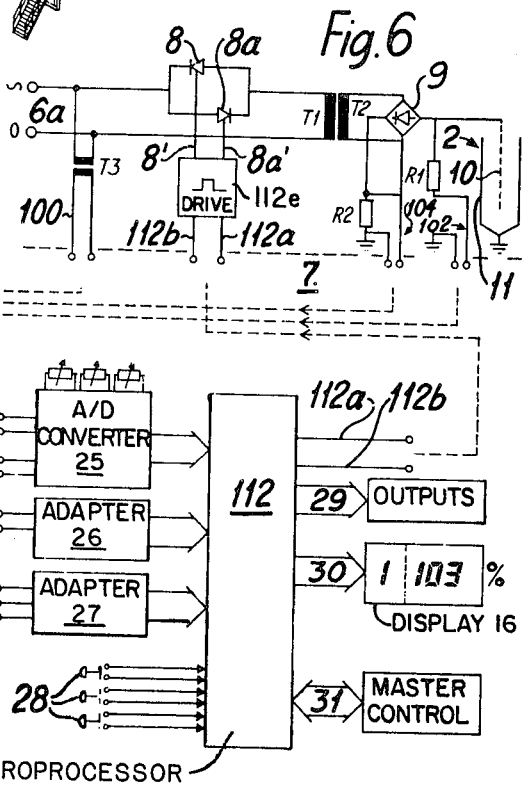
Fig. 6

| | | |
|---|---|---|
| Fig. 10 | Fig. 11 | Fig. 13 |
| | Fig. 12 | Fig. 14 |

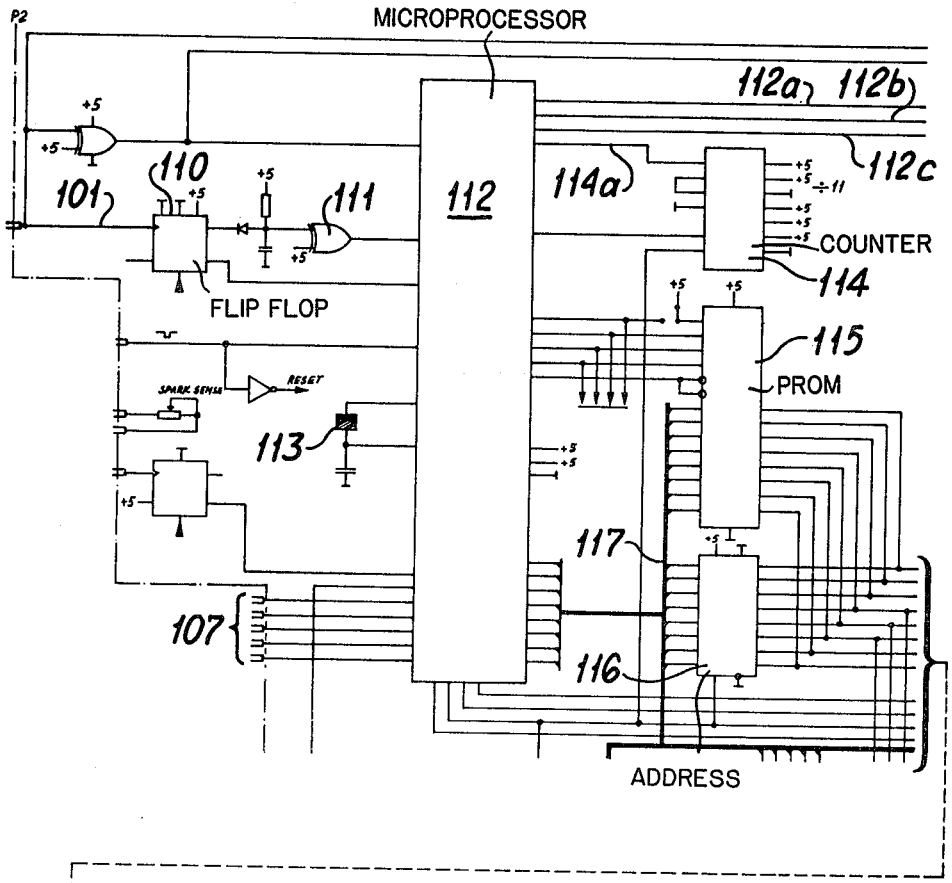
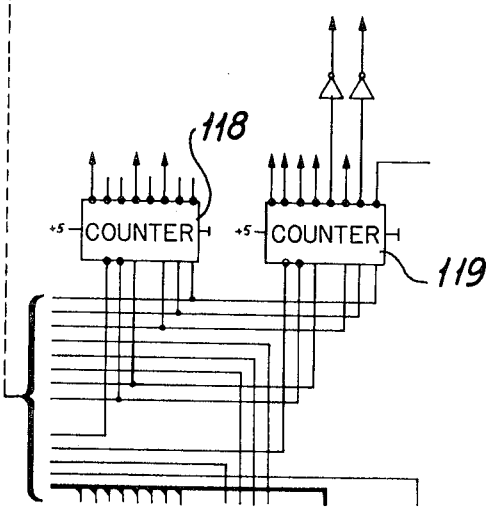
Fig. 11

CONTROL DEVICE FOR AN ELECTROSTATIC DUST SEPARATOR

TECHNICAL FIELD

The present invention relates to a control device, and in particular to a control device intended to be capable of effectively controlling the separation of dust in an electrostatic dust separator. This dust separator is of the type in which air containing particles of dust is caused to flow into the dust separator, where the particles are charged electrically by passing a high direct current voltage between adjacent plates or poles. By creating an electrically charged field between the plates, the particles in the contaminated air are given a certain charge, usually negative. These electrically charged particles are then attracted by the positive pole and are repelled by the negative pole. The effect of this electrical field on an electrically charged particle means that the particles collect in the area of the positive pole and that pure air is able to pass out of the dust separator.

A layer of particles is built up in this way on the positive plate or pole, and once a predetermined quantity has collected, the particles are shaken loose from the plate and fall into a particle collecting unit or container situated beneath the dust separator.

DESCRIPTION OF THE PRIOR ART

Electrostatic dust separators of the type described above have already been disclosed, and a number of different designs have been produced.

The previously disclosed devices are based on the fundamental principle that, the higher the voltage at the plates or poles, the better and more efficient is the dust separation. The voltage may not be too high, however, since this would produce sparking between the plates.

Previously disclosed devices have consequently incorporated various means of maintaining the voltage just below the discharge value, although this will vary depending on the particle structure and the quantity of particles which have collected on the pole, etc.

Because of corona effects, a power supply is also required to these electrostatic dust separators.

Also previously disclosed is a method of providing electrostatic dust separators with special control devices which are intended to provide a means of controlling the current of the supply voltage which serves as an alternating current voltage, thereby controlling the direct current voltage connected to the dust separator in such a way that the value of this voltage will lie just below the discharge value.

Control devices of this kind for electrostatic dust separators are accordingly designed to control in relation to a recorded value for the direct current and/or direct current voltage in the dust separator and with the help of passages through zero of a supply voltage which serves as an alternating voltage the switching in and/or out of rectifiers wired into the power supply lead to the dust separator suitable for alternating voltage and usually consisting of two thyristors.

Thus it is possible and necessary to regulate the value of the direct current and the value of the direct current voltage by controlling the length of the period for which the alternating current supply is switched in.

The control device used for this switching function has itself previously been disclosed, and, in common with other previously disclosed devices, the actual control function within the device is built up of analogue circuits.

It has also been suggested, however, that digital circuits, for example microcomputers, may be used to supply the analogue circuits with estimated reference values, on the basis of which values the analogue circuits can be made to regulate the dust separator.

DESCRIPTION OF THE PRESENT INVENTION

TECHNICAL PROBLEM

A particularly difficult technical problem has been encountered in conjunction with the design of a control device which is capable of regulating in a simple manner the electrical field in an electrostatic dust separator, in relation to the quantity of air contaminated with particles which is actually present and the capacity to treat it, so that the dust separation which takes place will be effectively regulated and highly efficient. In the event of a sudden and/or more gentle variation in the nature of the particle material, the particle size and/or the quantity of particles, the control device must be capable of adapting to these variations and of controlling the values of the current and of the voltage in the dust separator so that the separation of the dust may take place at maximum efficiency or to all intents and purposes maximum efficiency.

Problems which are particularly difficult to solve are encountered where several dust separators, which will usually be working in parallel, are to be controlled from a single master control unit, since the recorded values necessary for the control function are not easily accessible in the case of analogue control without complex interpreting circuits. A requirement exists in this case for the master control unit to include a digital processor so arranged as to monitor and control a number of dust separators via a control device belonging to each individual dust separator.

The wish attaching to the above has been to simplify communications between the master control unit and the control devices for the dust separators. The problem, however, has been to create conditions such that a number of processes may be controlled by simple means from a master control unit.

SOLUTION

The present invention relates to a control device for an electrostatic dust separator of the type described above, said dust separator being intended to be capable of controlling in relation to the recorded level of direct current and direct current voltage in the dust separator and with the help of passages through zero of a supply voltage which serves as an alternating current voltage the switching in and/or out of a rectifier wired into the power supply lead of the dust separator, said rectifier normally consisting of two opposing thyristors.

The invention is based on the possibility of including a data processing unit in the control device and of directly connecting to said data processing unit via conversion circuits the recorded value for the direct current and the recorded value for the direct current voltage together with the information relating to the passage through zero of the supply voltage, with the control device being so arranged that it is capable in relation to the value of the actual direct current and direct current voltage in the dust separator and with reference to the passages through zero of calculating a specific time interval for the switching in and/or switching out of the rectifier from the power supply, and that said switching-in and switching-out pulses are fed directly, via adapter circuits, from the data processing unit.

The present invention is also based on the possibility of causing direct current and direct current voltage monitoring circuits to be connected directly via amplifiers to a decoder, which in turn is connected to a data bus for the data processing unit. In a preferred embodiment of the invention, the data processing unit incorporates a microprocessor, which is connected in the familiar manner to a programmable memory, thereby producing a microcomputer.

The data processing unit can also be designed to generate activation signals for auxiliary functions, such as starting the transformer/rectifier unit, stopping the transformer/rectifier unit, alarm (warning) and alarm (stop), etc.

It is also possible to cause the data processing unit to be arranged in such a way as to control a "peak-seek" procedure, which is described in greater detail below.

TECHNICAL ADVANTAGES

The technical advantages which may be regarded as being associated with a control device in accordance with the present invention are that the control device can be produced simply in the form of a single unit and can be programmed to serve as an effective control device for an electrostatic dust separator.

Furthermore, there is considerable simplification of the possibility of utilizing calculated values for the actual levels of the direct current and the direct current voltage in the dust separator, at the same time as there are certain circuit engineering advantages in being able to calculate the passages through zero of an alternating voltage and to make use of the specific information which these passages through zero are able to provide.

It has also been found that a control device designed in accordance with the present invention may easily be installed for the purpose of controlling a dust separator which is already in operation, by substituting it for the previously installed control device.

Where a master control unit is to control and monitor a number of dust separator control devices, it has been found that communications (language) are made simpler because data processing units are used in the control unit and in each of the control devices.

Since the introduction of digital technology has now taken place to such a great extent, all signals intended for control purposes are now calculated mathematically and are usually stored and accessible in files, thereby considerably simplifying the interaction between the master control unit and the respective control devices for the respective dust separators, since the information, irrespective of its location, is interpretable and readable directly from the unit or devices.

What may be regarded as the principal characteristic features of a control device in accordance with the present invention are indicated in the following patent claims.

DESCRIPTION OF THE DRAWINGS

A control device in accordance with the present invention, installed in a previously disclosed electrostatic dust separator, may be described in greater detail with reference to the attached drawings, in which:

FIG. 1 shows a perspective view of a dust separator incorporating a number of units connected together one after the other (in series), but with only one transformer/rectifier for one unit shown in the form of an enlarged view above the rest of the dust separator;

FIG. 2 shows a number of control cabinets, each intended to house a single unit in accordance with FIG. 1, fitted with a control device designed in accordance with the present invention;

FIG. 3 shows a current diagram for a variable direct current intended to build up a direct current voltage in the dust separator which is illustrative of the operation of a dust separator which is controlled with the help of electrical discharges or spark-over inside the dust separator;

FIG. 4 shows a voltage/current diagram for the direct current voltage and the direct current respectively which are fed to an electrostatic dust separator, illustrating the conditions applicable to the "peek-seek" procedure;

FIG. 5 shows a current diagram which is illustrative of the operation of a dust separator controlled with the help of the "peek-seek" procedure;

FIG. 6 shows a block diagram for the transformer/rectifier unit and for the control device;

FIG. 11 shows the electrical wiring diagram for a data processing unit in the form of a microprocessor;

DESCRIPTION OF THE PREFERRED EMBODIMENT

Figures 7, 8, 9, 10:
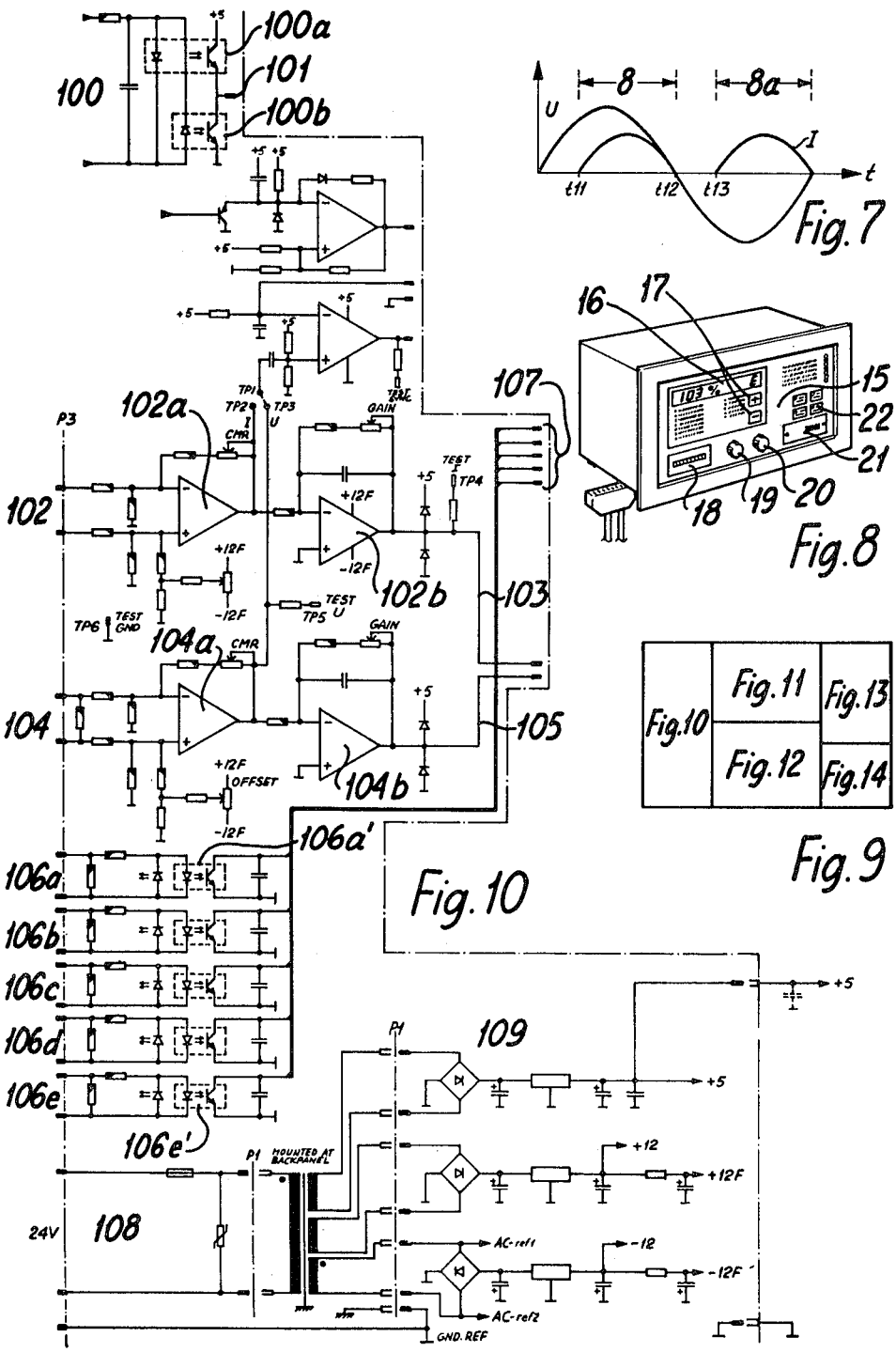
FIG. 7 shows the principle for the control of the alternating current value of the alternating voltage connected to the power supply cable, allowing the regulation of the power supply connected to and consumed by the dust separator on the basis of the supply of direct current and direct current voltage.
FIG. 8 shows a perspective view of the housing for a control device in accordance with the present invention.
FIG. 9 shows the lay-out of the detailed wiring diagram illustrated in FIGS. 10–14 required to form a continuous circuit.
FIG. 10 shows the electrical wiring diagram for the input circuits.

FIG. 1 thus shows a perspective view of an electrostatic dust separator unit 1, consisting of four adjacent dust separators connected together in series. A transformer/rectifier unit is required for each of these dust separators, although FIG. 1 shows only the unit intended for the dust separator 2, said unit having been identified by the reference designation 3. The manner in which the dust separators are connected is basically such that the exhaust from one dust separator is connected directly to the inlet of the following dust separator, and so on. Since the dust separator 2 is the final dust separator, its exhaust is connected to a chimney 4.

The dust separator unit 1 is of the type in which air contaminated with particles is fed into an inlet 5 and is allowed to pass into the first dust separator. In this type of dust separator, as in other types, the particles are charged electrically by the electrical field created between adjacent electrodes in the form of plates or poles by passing a high direct current voltage between said plates. Any particle of dust entering this field will be given a negative electrical charge and will then be attracted by the positive pole and repelled by the negative pole, thus causing particles to collect in the area of the positive pole. The air which has thus been purified by all the dust separators then passes through the exhaust outlet 5*a* to the chimney 4.

Dust separation takes place in this case with the help of a direct current voltage, said direct current voltage having its positive and negative poles connected to separate pole plates. A direct current must be supplied, however, because of the high voltage and the resulting corona effect around the pole plates.

The electrical field will cause electrically charged particles of dust to become attached to one of the pole plates or to one of the poles, where they will form a coating. Once it has reached the desired thickness, this coating is shaken from the plate mechanically and falls downwards. Thus the particles which have collected in the dust separator 2 will normally be collected in a container or particle collecting unit situated in the base 2*a* of the dust separator.

FIG. 2 shows a number of control cabinets, one for each of the four dust separators, where the control cabinet 6 is intended for the dust separator 2 and is connected by an alternating current via a cable 6*a* to a transformer/rectifier unit 3.

Exiting from this unit 3 is a connector 3*a* intended and dimensioned for direct current, said connector being connected in the customary manner to a pole plate inside the dust separator 2.

FIG. 2 also shows that the control cabinet 6 incorporates a control device 7 in accordance with the present invention, said control device being described in greater detail with reference to FIGS. 8–14.

FIG. 3 illustrates an initial control function for the control device in accordance with the present invention. In FIG. 3 the line 'IM' indicates the maximum current value of the rectifier and the lines 'IS' indicate the maximum operating current. The value of 'IS' may range from 60% to just under 100% of the value of 'IM'.

It has been assumed that the current value 'IS' has been set before being fed to the dust separator, said direct current ensuring that the dust separation takes place at a high direct current voltage and at high efficiency. A variation in the conditions inside the dust separator will cause an electrical discharge to occur at the time 't1'. This discharge will activate various circuits, with the result that the output from the transformer/rectifier unit 3 will be blocked for less than 20 ms, i.e. until the time 't2'. The current will be restored to a value 'T1' during the period between 't2' and 't3', which is related to the value 'IS' but with a reduction in its value by the amount 'S'. The value of 'S' may be adjusted to between 3 and 20% of the set value 'IS'.

The control device is designed to control the rise time, i.e. once the current value has been established after the discharge at the time 't3', the current will increase gradually either until a new discharge takes place, which is shown at the time 't4', or until the current level or current value 'IS' is reached and, if this is the case, remains at that value.

The dust separator is thyristor controlled, enabling the input value of the voltage to the transformer/rectifier unit 3 to be regulated between 0 and 100% by adjusting the timing of the activation impulse to the thyristor in a suitable manner to match the passages through zero of the supply voltage.

It has been found, however, that the pole plates in the dust separator may become coated with a highly resistive layer of carbon, and that the effect of the formation of such a coating is to prevent the discharge from taking place at the maximum level of efficiency; the current value should be adjusted to 'IS' at the same time as the voltage value falls and a reduced level of efficiency is obtained for the dust separator.

FIG. 4 shows the current/voltage curve when the pole plate is coated with highly resistive carbon. One characteristic feature of this is that, as the current increases in value, a corresponding increase takes place in the voltage proportional to the value 'A'. Any further increase in the current will cause the curve to level-off, and an increase in the current at point 'B' will produce no increase in the voltage.

Increasing the current beyond point 'B' will result in a gradual reduction in the value of the voltage until the point 'C' is reached, after which any increase in the current will produce a proportional reduction in the voltage until the maximum current value 'IS' is reached at point 'D'.

It is not advisable in any case, where highly resistive carbon is present, to control the current beyond its value at point 'C', since this may involve major power losses and poor efficiency.

Control based on 'electrical discharge' in accordance with FIG. 3 may not be used in this case, since a control circuit of this kind would immediately select the current value 'IS'.

Consequently, where the pole plates are coated with highly resistive carbon deposits, control must be provided on the basis of an entirely different principle, i.e. the 'peek-seek' function, which involves the instantaneous calculation of the current and voltage values and the determination of the level and symbols for the values, which represent the conditions and input values for the control of the dust separator. This is described in greater detail below.

FIG. 5 shows that a discharge takes place at the time 't1'and that at the time 't2' the current is reconnected in a similar manner to that shown in FIG. 3. By allowing the current curve to increase gently until it reaches the time 't8', and then to fall gently until it reaches the time 't9', and then increasing the current once more until the time 't10' is reached, and so on, it is possible to drive the dust separator with a variation in voltage within the range 'A' to 'C' shown in FIG. 4, enabling the dust separator to be used to provide maximum dust separation.

FIG. 6 shows a wiring diagram for a transformer/-rectifier unit and for the control device, from which it may be seen that the alternating current supply cable 6*a* is connected to two opposing thyristors 8, 8*a*, each of which is provided with its own control electrode 8′, 8*a*′ which are connected to the control device 7. In this way control of the current is provided by an inductance contained in a transformer winding 'T1'. The transformer winding 'T1' interacts with the transformer winding 'T2', which is connected to a rectifier bridge 9. To the pole plate 10 in the dust separator 2 is connected the positive voltage, which may be regarded as being rectified and compensated because of the capacitance which is present between the grounded pole plate 11 and the pole plate 10.

Instantaneous direct current voltages may be calculated via the cable 102 across a resistance R1, whereas instantaneous direct current values may be calculated via the cable 104 across a resistance R2.

The passages through zero of the alternating current voltage may be calculated via the cable 100 connected to a transformer T3.

The current and voltage values in the cables 102 and 104 are connected to an analogue/digital converter 25, which in turn is connected directly to a microprocessor 112.

The signal which will provide information in respect of the passages through zero of the alternating voltage in the cable 100 is connected to an adapter circuit 26, which in turn is connected directly to the microprocessor 112.

The microprocessor 112 is provided with direct connections which are able, via adapter drive circuits 112*e*, to influence and control the switching-in of the thyristors 8, 8*a*. This is done via the cables 112*a* and 112*b*.

Alarm circuits are connected to the microprocessor 112 through an adapter circuit 27 and manually-operated checking buttons are provided at 28. Output circuits are also provided for the on/off function, as well as indicators for alarms of various degrees of importance; these have been identified by the reference designation 29.

The microprocessor 112 also has connections 30 for the display unit 16.

Finally, the microprocessor 112 has connections 31 for communications with a master control unit, which is of the same basic design as the control device but is operated by a different program, depending on the functions which are to be controlled and monitored by the control unit.

FIG. 7 shows that the thyristor 8 is connected at the time 't11', thereby causing a current impulse to pass through the transformer winding 'T1'. This current impulse ceases at the time 't12', and the thyristor 8*a* is connected at the time 't13', thereby causing a new current impulse to pass through the transformer winding 'T1'.

With reference to FIG. 8, a more detailed description will now be given of the external configuration of the control device; the front panel is identified by the reference designation 15, and has a display unit 16, which on the one hand indicates the actual setting (103%) and on the other hand indicates the actual range of measurement by means of a number (1).

Buttons 17 are used to index through the desired range of measurement or to the desired point of measurement, by depressing either the button marked (+) or the button marked (−). A counter 18 is used to indicate the number of electrical discharges inside the dust separator. Rotating knobs 19 and 20 enable certain adjustments to be made, and adjustments may also be made by means of a number of adjuster devices which are located behind a covering plate 21 but which are not shown in the drawing.

A preferred embodiment of a control circuit will now be described in greater detail with reference to FIGS. 10–14, with FIG. 9 indicating the relative positions of FIGS. 10–14.

FIG. 10 shows an electrical wiring diagram for certain components which are included in the control device, above all the input circuits. The reference designation 100 is used to indicate the point at which a voltage enters via a cable, said voltage being used as a reference voltage which is itself used specifically for the purpose of determining the passages through zero of the supply voltage. This is done by using two opposing opto couplers, with the reference designations 100*a* and 100*b*, and with the common point for the opto couplers connected to a cable 101. The opto-couplers comprise switches in which light emitters cooperate with light-sensitive receivers.

The reference designation 102 is used to indicate a cable which carries an input signal which is dependent on the instantaneous value of the direct current in the dust separator, said signal being linked and connected to an amplifier 102*a* and to an additional amplifier 102*b*, whose output is connected to a cable 103.

The reference designation 104 is used to indicate a cable which carries an input signal which is dependent on the instantaneous value of the direct current voltage in the dust separator, said signal being linked and connected in a similar fashion to an amplifier 104*a* and to an additional amplifier 104*b*, whose output is connected to a cable 105.

The pairs of cables which represent the inputs 106*a*–106*e* are intended to switch in various alarm criteria inside the dust separator, and each is connected via opto couplers 106*a*′–106*e*′ to its own cable in a cable bunch 107.

The reference designation 108 relates to cables which carry the alternating voltage supply (24 V) and the subsequent power supply equipment 109.

FIG. 11 shows that the signal for the passages through zero (on cable 101) is connected to a flip-flop circuit 110, one of the outputs from which is via a delaying circuit 111 connected to one input for a microprocessor 112, and the second output of which is connected to a second input for the microprocessor. A preferred microprocessor for this application is that sold by the INTEL Corp., of California, USA, under the reference 8039. The microprocessor has been given the reference designation 112 in the drawing.

A crystal 113 is connected to two inputs for the microprocessor 112, thereby creating a reference in the form of clock pulses.

An auxiliary counter 114 is so arranged as to generate 256 pulses per half period and is thus able to fire the thyristors 8 and 8*a*. The counter is zeroed via the cable 114*a*, and the precise, time-related switching in of the thyristors 8 and 8*a* is controlled via the cables 112*a* and 112*b*; these cables are thus connected to the inputs 8′ and 8*a*′. Pulses are transmitted along the cable 112*c* to the counter 18, where they add to the number of discharges in the dust separator.

The reference designation 115 is used to indicate a programmable memory, which is connected not only to an address unit 116 but also to a data bus 117, which likewise interacts with the microprocessor.

Other counters 118, 119 are also provided for the purpose of generating the necessary strobe pulses.

Figure 12:
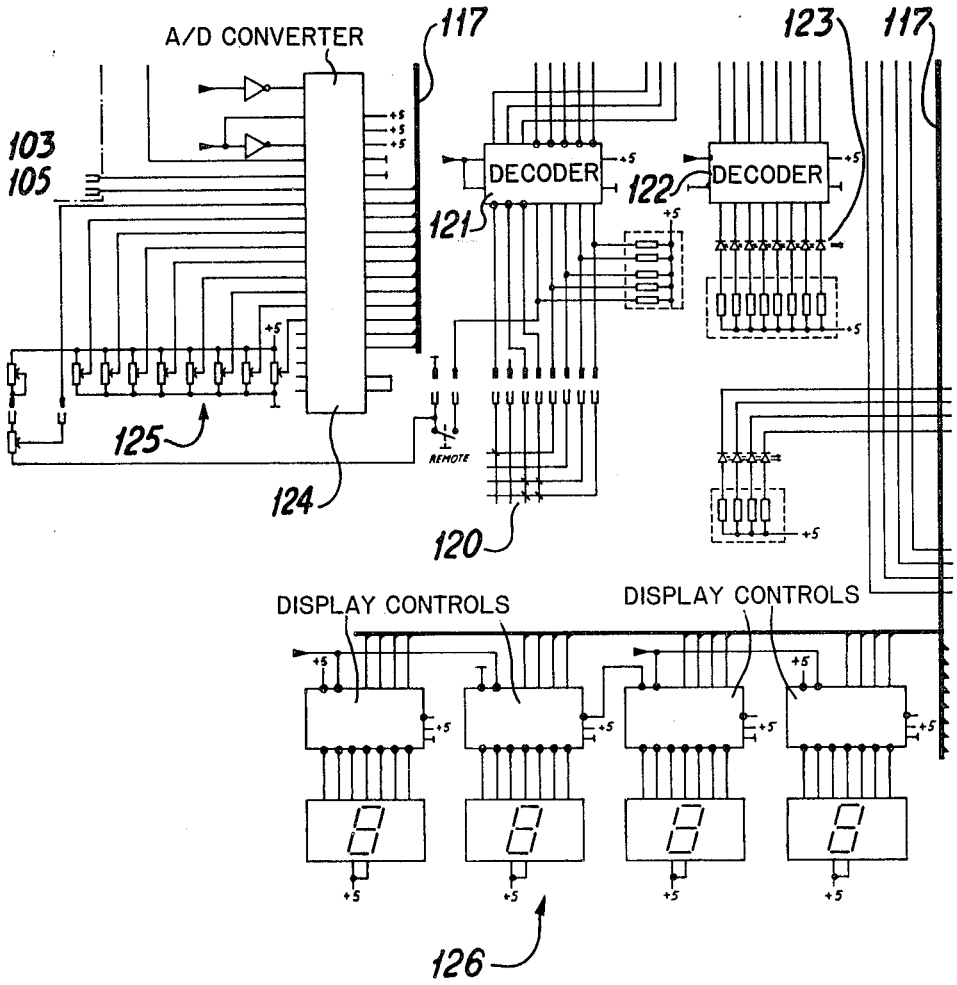
FIG. 12 shows the electrical wiring diagram for certain auxiliary functions and the display unit.

FIG. 12 shows the data bus 117, to which are connected on the one hand a set of buttons 120 with an associated decoder 121 and on the other hand a decoder 122 for a number of light-emitting diodes 123.

The reference designation 124 is used to indicate an analogue-digital converter, to which on the one hand the recorded values for the direct current and the direct current voltage are connected, via the cables 103 and 105, and where on the other hand a number of potentiometers 125 are provided, on which various values may be set in conjunction with the operation of the control device. These potentiometers are situated behind the cover plate 21.

The reference designation 126 is used to indicate components of the display unit, which has been given the general reference designation 16 in FIG. 8.

Figure 13:
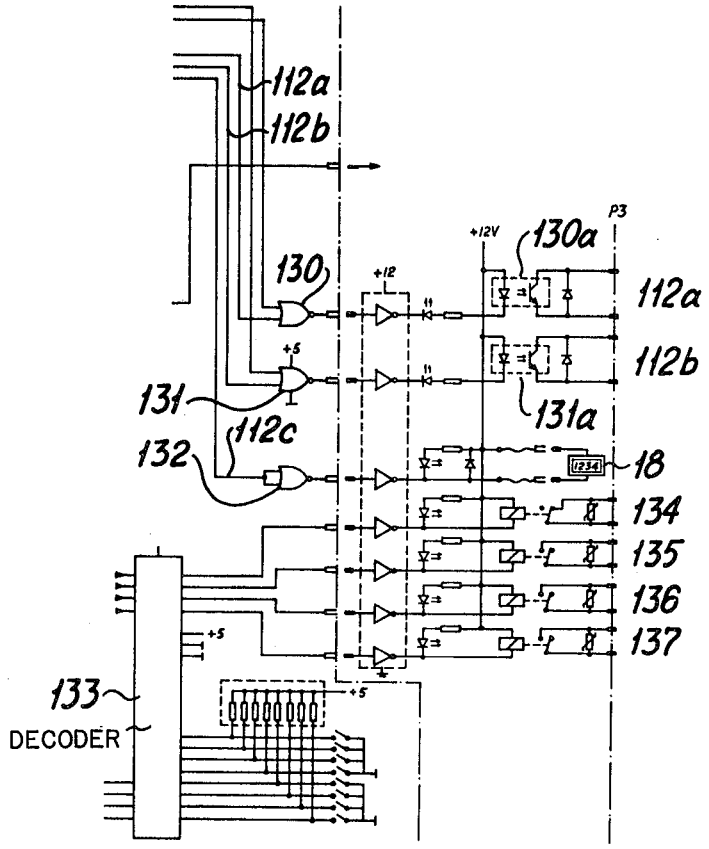
FIG. 13 shows the electrical wiring diagram for output circuits intended to control functions in the dust separator, as well as the connection of the rectifiers in the power supply circuit.

FIG. 13 shows that the cables 112*a* and 112*b* are each connected to its own output circuit 130, 131, whilst the cable 112*c* is connected to an output circuit 132.

The circuit 130 controls the opto coupler 130*a* which controls the thyristor 8 via the cable 112*a*, whilst the opto connector 131*a* is intended to control the thyristor 8*a* via the cable 112*b*.

The circuit 132 is intended to control the counter, which has been given the reference designation 18 in FIG. 8.

A decoder 133 is also provided for the purpose of controlling a number of alarm functions and other functions. Thus the cable 134 can be used to provide a start pulse for the transformer/rectifier unit, the cable 135 can be used to provide a stop signal, the cable 136 can be used to provide a low-priority alarm signal, which only gives a warning, and the cable 137 can be used to provide an alarm signal of higher priority, which involves interrupting the function of the dust separator and disconnecting the voltage and current.

Particular consideration should be given to the fact that the operation of this control device calls for a program for the microprocessor. This has not been described in greater detail, since programming lies well within the limits of normal technical skills when considering the above specification.

Figure 14:
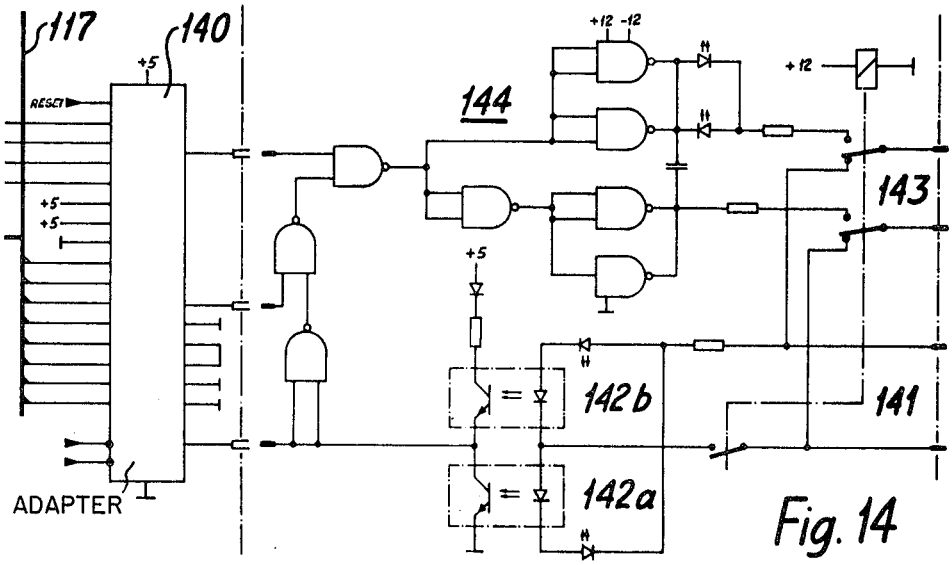
FIG. 14 shows the electrical wiring diagram for output circuits intended to control communication with a master control unit.

FIG. 14 shows those circuits which make communication possible with the master control unit (not shown). An adapter circuit 140 is connected to the data bus 117. This circuit constitutes a parallel-series converter for the flow of information in both directions. The circuit may best consist of an UART circuit (Universal Asynchronous Receiver Transmitter).

The flow of signals to the control device takes place via the cable 141 and the opto couplers 142*a* and 142*b*, whilst the flow of signals from the control device takes place via the cable 143 across a number of drive stages 144.

The front panel shown in FIG. 8 is fitted with a push-button 22, called the 'PEEK-SEEKER', which is used to activate or de-activate the 'peak-seek' function. A red light-emitting diode will be lit in the top left-hand corner of the button if the function is in the active mode.

Provided that the 'peek-seek' function has been activated, the following procedure will be operated in the processor's program.

At predetermined intervals of time, the continuously operating collection processes of the processor will take samples of the direct current voltage (102) and the direct current (104) which are being fed to the dust separator. An instantaneous test is compared with the previous test, and if both the current and the voltage have risen or fallen, then the contents of one memory cell will be reduced by 1. If only one has risen and the other has fallen, then the contents of the memory cell will be increased by 1.

When the memory cell reaches its maximum value, let us say 8, the processor will reverse the manner in which it is controlling the current so that this will fall instead. If the memory cell reaches its minimum value, let us say 0, then the processor will revert to controlling the current in the normal fashion.

This control procedure results in the current always being regulated in such a way that the operating point (either side of B) plotted on the current/voltage curve in accordance with FIG. 4 will be situated either on or in the immediate vicinity of the point at which the derivative of the current/voltage curve will be equal to 0, or, in other words, the peak of the curve. This is the origin of the name 'peek-seeker'.

The present invention relates to the possibility of causing a delay in the signal, depending on the number of passages through zero. It must be remembered that for each half period (10 ms at 50 Hz) the processor must calculate a new firing point or time for the thyristors 8, 8*a*, and, once this firing time has been reached, must generate the necessary firing pulse to the thyristor which is to be fired. This is by far the most important task of the control device. The firing time must be calculated in advance and firing must take place at the correct moment, failing which disturbance will be produced in the power supply with a resulting decline in the level of efficiency of the dust separator. The passages through zero of the mains voltage are used in order to achieve a precise time reference. A short pulse is generated for each passage through zero by means of two opto connectors 100*a*, 100*b* and a number of gate circuits (FIG. 10).

What is most important, however, is that the firing of the thyristors should occur at a precise point in time. The pulse for the passage through zero thus causes all other activity in the processor to be interrupted, since it is made to enter the processor 112 via a so-called interruption input.

This should mean an immediate start to the calculation of the firing point or firing time, although this is not the case, unfortunately. The processor has its own internal counter, which has its own entirely separate internal interruption input, and this counter is used constantly by the subsidiary processes. If this counter has arranged for its own interruption to take place immediately before the interruption due to the passage through zero, then the interruption due to the passage through zero will be obliged to wait until the internal interruption is complete; this period of waiting is too long to be acceptable. This inconvenience may be eliminated by arranging for a delay to occur in the interruption due to the passage through zero, so that it will arrive one millisecond or so later. The risk of a collision taking place between the interruptions is still as great, although if the non-delayed signal is connected simultaneously to one input and causes the subsidiary process, which is to make use of the internal counter, to scan the input first in order to determine whether any interruption is to be anticipated, and if this is the case to abstain from starting up the counter, then the risk of collision will have been eliminated. In addition to the requirement for the subsidiary processes to scan said input each time they are to start up the counter, this process also requires that the calculation of a new firing angle or firing time should start one millisecond or so later. This has no practical significance, except for the fact that no current is able to flow through the thyristors during the first few milliseconds, depending on the counter-electromotive force generated by the filter. This time will be sufficient both for the delay and for the calculation of the new firing time.

The present invention is not, of course, restricted to the typical preferred embodiment described above, but may undergo modifications within the context of the following patent claims.

We claim:

1. A control device for an electrostatic dust separator having electrodes, an a.c. power supply with rectifiers to generate intermittent power impulses, and means to convert said power impulses to direct current which is supplied to said electrodes, said control device comprising a first means sensing the level of direct current in said separator, a second means sensing the d.c. voltage in the separator, a third means sensing the zero point in the a.c. voltage of said a.c. power supply, and a data processing unit controlling said rectifiers, said data processing unit being coupled to said first, second, and third sensing means so that in response to actual direct current and actual d.c. voltage in the separator and time-related to said zero points in a.c. voltage, said processor both calculates a specific time duration for the power impulses through said rectifiers and also generates switching-in and switching-out pulses and feeds them to the rectifiers.

2. A control device in accordance with claim 1, wherein said rectifiers comprise a pair of thyristors.

3. A control device in accordance with claim 1, wherein said data processing unit has a data bus, said control device including amplifiers and a converter connecting the first and second sensing means to said data bus of the data processing unit.

4. A control device in accordance with claim 1, including a flip-flop circuit connecting said third sensing means to the data processing unit.

5. A control device in accordance with claim 4, including a signal delaying circuit between the flip-flop circuit and the data processing unit.

6. A control device in accordance with claim 1, including a master control unit and a communications link connecting said data processing unit to said master control unit.

7. A control device in accordance with claim 5, wherein said first, second and third sensing means transmit signals to the data processing unit which are interpretable by the master control unit.

8. A control device in accordance with claim 1 in which the separator voltage peaks relative to the separator current upon increase and decrease of the power impulses supplied to the separator, wherein the data processing unit controls the rectifiers in a number of chronologically separate steps to maintain said voltage near the peak voltage.

9. A control device for an electrostatic dust separator in accordance with claim 1 wherein the means for sensing the current and the means for sensing the voltage together with the means for sensing the zero point of the supply a.c. voltage are connected directly by conversion circuits to said data processing unit.

10. A control device in accordance with claim 1 wherein said switching-in and switching-out pulses are fed directly by adapter circuits from the data processing unit.

11. A control device in accordance with claim 1, wherein said direct current and d.c. voltage sensing means are connected by amplifiers to a converter which in turn is connected to the data bus of the data processing unit.

* * * * *

UNITED STATES PATENT AND TRADEMARK OFFICE

CERTIFICATE OF CORRECTION

PATENT NO. : 4,486,704

DATED : December 4, 1984

INVENTOR(S) : Alf G. Gustafsson and Sigvard Matts

It is certified that error appears in the above-identified patent and that said Letters Patent is hereby corrected as shown below:

Cover Page, Foreign Application Priority Data, "Fed. Rep. of Germany" should be --Sweden--;
Column 7, line 18, after "adapter" insert --and--;
Column 10, line 19, delete "disturbance" and insert --disturbances--;
Claim 1, penultimate line, delete "-in and switching-out".

Signed and Sealed this

*Twenty-eighth* Day of *May 1985*

[SEAL]

*Attest:*

DONALD J. QUIGG

*Attesting Officer* *Acting Commissioner of Patents and Trademarks*